US005160584A

United States Patent [19]

Fredriksson

[11] Patent Number: 5,160,584

[45] Date of Patent: Nov. 3, 1992

[54] HIGH CONSISTENCY SHEET FORMER

[75] Inventor: Borje Fredriksson, Sundsvall, Sweden

[73] Assignee: Beloit Technologies, Inc., Wilmington, Del.

[21] Appl. No.: 707,429

[22] Filed: May 28, 1991

Related U.S. Application Data

[63] Continuation of Ser. No. 421,047, Oct. 12, 1989, abandoned.

[51] Int. Cl.[5] ..... D21F 1/02; D21F 1/08

[52] U.S. Cl. ..... 162/318; 162/214; 162/216; 162/317; 162/336; 162/337; 162/339; 162/341; 162/342

[58] Field of Search ..... 162/214, 216, 308, 317, 162/318, 336, 337, 339, 341, 342, 343

[56] References Cited

U.S. PATENT DOCUMENTS

| | | | |
|---|---|---|---|
| 2,859,668 | 11/1958 | Berlyn | 162/343 |
| 3,255,074 | 6/1966 | Salomon et al. | 162/339 |
| 3,758,378 | 9/1973 | Berger et al. | 162/216 |
| 3,960,654 | 6/1976 | Calehuff | 162/343 |
| 4,085,003 | 4/1978 | Luthi | 162/317 |
| 4,158,596 | 6/1979 | Justus | 162/339 |
| 4,258,455 | 3/1981 | Werner | 19/303 |
| 4,318,805 | 3/1982 | LeBlanc | 209/273 |
| 4,430,159 | 2/1984 | Bubik et al. | 162/292 |
| 4,659,432 | 4/1987 | Stenberg | 162/318 |
| 4,717,453 | 1/1988 | Reiner | 162/317 |

*Primary Examiner*—W. Gary Jones
*Assistant Examiner*—Todd J. Burns
*Attorney, Agent, or Firm*—Dirk J. Veneman; Raymond W. Campbell

[57] ABSTRACT

A papermaking machine is constructed as a barrier former in which a fiber slurry is received and placed in turbulence on one side of the screen plate for fluidizing the slurry and distributed through the screen plate onto a collecting wire, under tension, for immediately starting dewatering of a web formed in a wedge-shaped forming zone between the screen plate and the wire.

7 Claims, 3 Drawing Sheets

HIGH CONSISTENCY SHEET FORMER

This is a continuation of copending application Ser. No. 07/421,047 filed on Oct. 12, 1989, now abandoned.

The present invention relates to a sheet former and more particularly to a barrier former in which a slurry flows through a screen plate which forms a barrier between two different energy levels of the material.

M. J. Berlyn in U.S. Pat. No. 2,859,668 discloses a cylindrical headbox in which an impeller imparts a cylindrical whirling motion to paper stock which exits the device through a tangential slice. Inasmuch as more stock is fed to the headbox than flows through the slice, an overflow opening is provided.

In U.S. Pat. No. 3,225,074, S. M. Salomon et al disclose a substantially cylindrical apparatus having impellers for forcing stock through a screen; however, the impeller and the screen are not directly involved in forming the paper web.

Edgar J. Justus in his U.S. Pat. No. 4,158,596 discloses a distribution wire for aiding in the random orientation of fibers. In this technique the stock is passed through the distribution wire onto the forming wire.

In U.S. Pat. No. 4,258,455 Edward E. Werner discloses a dry process in which fibers enter through a cylindrical housing and an impeller forces the fibers through a screen to form a fibrous sheet on a wire.

In U.S. Pat. No. 4,318,805, Peter E. LeBlanc discloses the use of a cylindrical shell, an impeller and spaced screens through which the impeller forces a stock slurry.

Alfred Bubik in U.S. Pat. No. 4,430,159 discloses a twin-wire papermaking machine in which stock is fed at a high pressure through one of the wires to form a paper ply between the two wires.

The object of the present invention is to provide a new high consistency sheet former in the form of a barrier former in which a screen plate is employed as the barrier for distributing fibers into the sheet.

The above object is achieved, according to the present invention, by the provision of a method and an apparatus for forming a sheet from a slurry which comprises a fiber concentration in which the slurry is flowed toward a first side of a screen barrier and a collecting wire is moved along the opposite side of the screen barrier to provide a forming zone therebetween. The energy of the slurry is increased on the first side of the screen barrier and the fibers are distributed through the screen barrier onto the wire to form a web while the web is simultaneously pressed in the forming zone to begin immediate dewatering.

In order to increase the energy of the slurry on the first side of the screen barrier, a turbulence device is provided in the form of a rotor having projections extending therefrom and moving through a space between the rotor and the screen barrier, the screen barrier conforming to the cylindrical shape of the rotor. The collecting wire is a continuous structure entrained about the screen plate and a plurality of rolls, at least one of the rolls being mounted for adjustment of the tension of the collecting wire. The screen barrier may be in the form of a fixed arcuate screen plate, a rotatable screen drum, or an endless barrier band.

In contrast to the art set forth above, the present invention offers a plurality of novel features as set forth hereinbelow.

A first novel feature is the barrier concept. The screen structure acts as a barrier between pulp of two different energy levels. In order to make pulp flow through a screen barrier at a high consistency, it must be fluidized. For a given type of pulp at a given consistency, there is a minimum energy intensity which is required for fluidization of the fiber suspension. This minimum energy intensity increases very quickly when the consistency increases. As an example, according to a study conducted by Professor Richard J. Kerekes at the University of British Columbia;

| Cons. % | Fluidization Power $KW/M^3$ | Typical Range for |
|---|---|---|
| 0.5 | .33 | |
| 1.0 | 12 | PM Headbox |
| 2.0 | 455 | Cleaners Screens |
| 3.0 | 3,920 | |
| 4.0 | 17,200 | |
| 5.0 | 58,200 | |

The above tabulation illustrates that the pulp can be fluidized at high consistencies at the expense of high energy input. In order to keep the energy requirement low one must work with the smallest possible volume. When the consistency is doubled, the fluidization energy increases approximately fourty times.

A second feature of the invention is that the dewatering begins as soon as the pulp has reached the low energy side of the barrier. The pulp is not given time to refloculate; instead the consistency is increased in order to aid in the consolidation of the sheet being formed. If the consistency is sufficiently high, the strength of the fiber network at the low energy side of the screen plate is too high to permit fibers to move and floculate before the sheet is consolidated.

Another feature of the invention is that the dewatering portion of the former is closed. It is pressure fed and the feed pressure is counteracted by the pressure drop over the screen plate and over the pulp mat supported by the wire tension. The drained volume is sealed by the outgoing mat of pulp squeezed between the barrier cylinder and the wire wrapped therearound and therewith providing not only a forming zone but an initial dewatering zone.

According to another feature of the invention, by feeding the forming zone perpendicular to the wire through a stationary forming barrier into a wedge-shaped dewatering volume, the first layer on the wire side has been partially dewatered when the next layer of high consistency pulp is laid on top of the first layer. In this manner, the dewatering of the sheet helps to consolidate the sheet structure and prevent refloculation by maintaining a higher average consistency in any cross section of the sheet in the dewatering zone than the feed consistency.

According to another feature of the invention, feeding the forming zone through a stationary perforate roll makes it possible to have different size perforations in different sectors of the barrier. Therefore, different sectors of the forming zone can be fed by different types of fibers due to fractionation of the feed stock by the barrier screen plate before it enters the forming zone. This is a particularly important feature, especially for heavier grades of paper and board.

IN THE DRAWINGS

Other objects, features and advantages of the invention, its organization,construction and operation will be best understood from the following detailed description, taken in conjunction with the accompanying drawings, on which:

As examples of different ways the invention can be utilized, three principally different embodiments will be discussed:

A. High consistency sheetformer with stationary barrier (screenplate). This configuration can be fed with a distributor pipe across the width of the former or with an internal distributor inside the rotor in the former.

B. High consistency sheetformer with a rotating barrier (screenplate). This configuration can also be designed with different ways to feed the stock to the forming zone. By varying the relative velocity of the wire and the rotating barrier, it is possible to control the fiber orientation in the sheet.

C. High consistency sheetformer with a moving perforated band as barrier. This design concept is the twin wire version of the barrier former as the band can be utilized to support the mat for two-sided drainage and control of fiber orientation.

As mentioned above, the screen may have slots, circular holes, different hole patterns in different sections and the like, and all of these apertures will be referred to below as simply a perforate structure.

Figure 1:
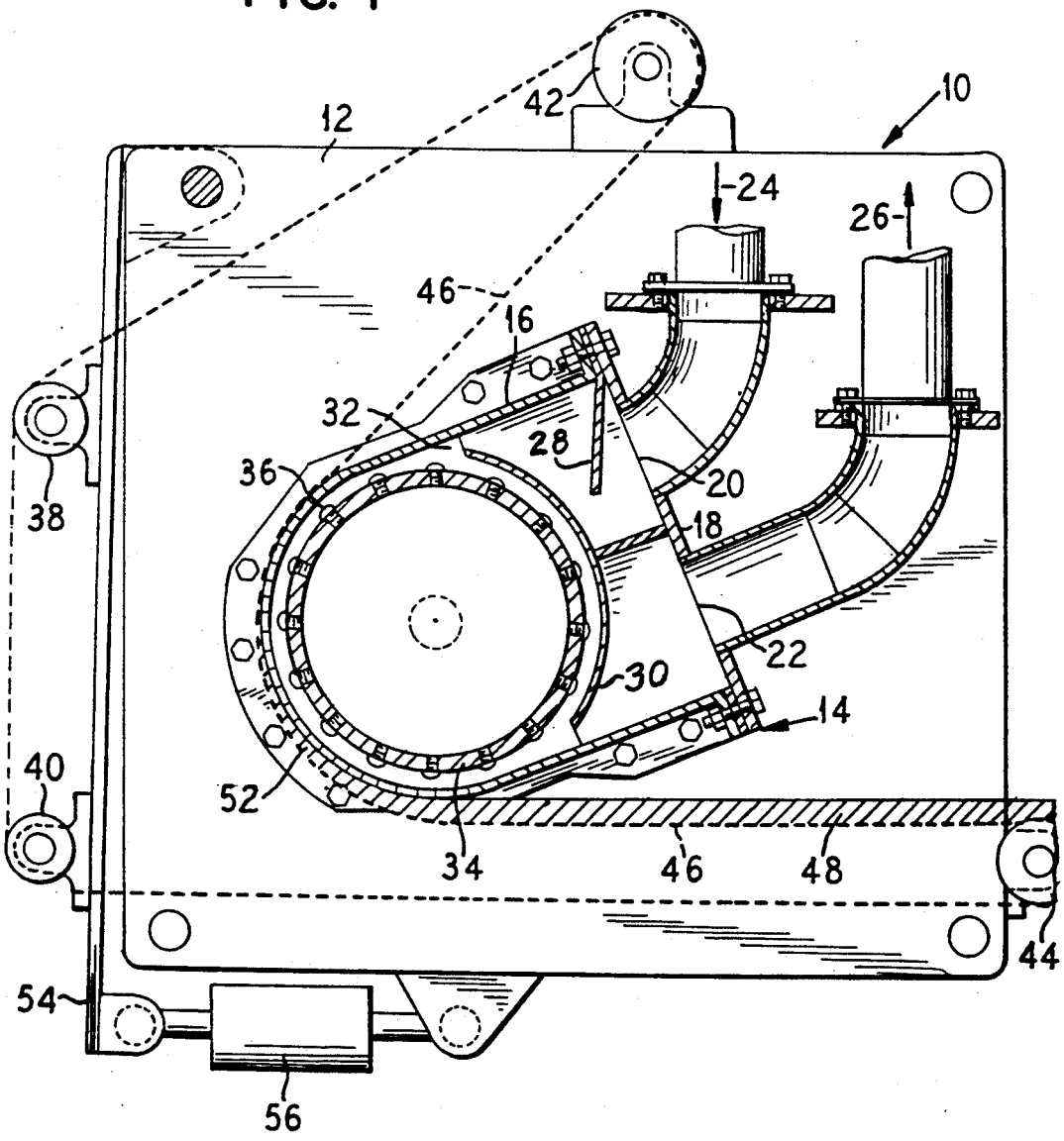
FIG. 1 is a sectional view of a high consistency sheet former constructed in accordance with the present invention.
Figure 2:
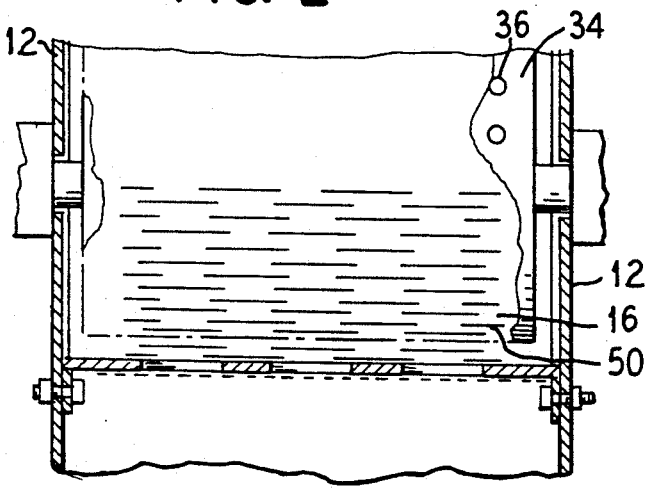
FIG. 2 is a fragmentary end view showing a slotted barrier screen plate.

Referring to FIGS. 1 and 2, a barrier former of the first type is generally illustrated at 10 as comprising a pair of end mounting plates 12 mounting a barrier structure 14 and a rotor 34.

The barrier structure 14 includes a screen plate 16 having a cylindrical end and a cover 18. The cover 18 includes an input opening 20 and an overflow opening 22 for receiving the pulp as indicated at the arrow 24 and discharging an overflow as indicated at the arrow 26.

A deflection plate 28 causes the pulp to traverse a tortuous path which is generally defined by the deflection plate 28 and an arcuate plate 30 to reach a gap 32 between the cylindrical portion of the screen plate 16 and the rotor 34.

In order to prevent floculation, the rotor is designed for high frequency and a high energy transfer in order to fluidize the incoming stock at the highest possible consistency. As an aid in increasing the energy transfer to the pulp, a plurality of pulse generators 36, such as bolts, shims and the like, are carried on the rotor to create a turbulence in the gap between the rotor and the screen plate.

A plurality of rolls 38,40,42 and 44 and the screen plate have a collecting wire 46 entrained thereabout for collecting the stock as it passes through the slots 50 and into a wedge-shaped forming zone between the collecting wire 46 and the screen plate 16.

Figure 3:
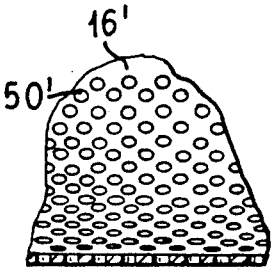
FIG. 3 is a fragmentary view of a screen plate having circular holes.

As shown in FIG. 3, a screen plate 16' may have circular perforations 50'.

In order to adjust the tension on the collecting wire 46, the rolls 38 and 40 are mounted on a pivotal plate 54 and an adjustment device 56 is provided for pivoting the plate 54 with respect to the mounting plate 12. The adjustment device may be, for example, a hydraulic or pneumatic ram, or a threaded device on the order of a turnbuckle.

The roll 44 is spaced from the forming zone 52 in order to provide support for the formed sheet until it exits the barrier sheet former.

A barrier sheet former of this first type has been constructed along the lines of the following example set forth in terms of capacity, power requirements, dewatering pressure, fiber orientation and sheet structure.

The capacity of a high consistency screen is in the order of 300–800 ton/m$^2$/day, depending on the type of stock, consistency and energy input (degree of fluidization). This is based on the screening capacity of well known screens utilized for other purposes. It is known in the art of screening that there is a balance between the degree of fluidization and capacity, on the one hand, and screening efficiency, on the other hand. If one is not concerned with screening efficiency, the energy input and the capacity can be increased.

It should be pointed out that the cylindrical portion of the barrier former screen plate of the first type can be perforate over about 145° and should be highly polished. One may calculate the forming area with a diameter of 0.6 meters as 0.73 m$^2$ per meter width and, at a 400 ton/m$^2$/day a capacity of 300 ton/m/day may be achieved. Inasmuch as most high capacity paper and board machines are about or below 100 ton/day and meter width, the barrier former of the present invention is not restricted in capacity.

The power requirement for the barrier former may be determined from different types of known screens such as:

| | | |
|---|---|---|
| Conventional LC Screen | 1–2% | 10 kWh/ton |
| Esher-Wyss Hc Screen | 3–5% | 15–25 kWh/ton |
| STFI HC Screen | 3–4% | 20–30 kWh/ton |
| Bellmer Centrifiner HC Screen | 3–5% | 20–30 kWh/ton |
| Bird Barrier Screen | 3–5% | 10 kWh/ton |

With a production target for a particular application at 120 ton/meter width/day, at 20 kWh/ton the power requirement will be 100 kW/meter width. However, the energy requirement is not directly related to production; it is considered to be more related to the properties of the pulp suspension and the volume of the suspension being fluidized. Laboratory trials have shown an energy requirement of about 50 Kw/meter width.

The dewatering pressure is caused by the tension in the collecting wire 46 and may be calculated in accordance with the relationship $$P=T/R$$

where P is the dewatering pressure in kPa, T is the wire tension in kN/m and R is the radius in meters.

The following table is provided as an example

| Case | A | B | C |
|---|---|---|---|
| Rm | 0.15 | 0.15 | 0.30 |
| Pk Pa | 40 | 67 | 20 |
| TK N/m | 6.0 | 10 | 6.0 |

As can be seen, one may obtain pressures which are low compared to the accept pressure in most screens. Therefore, there is no problem to counteract the wire tension with the pressure on the accept side of the screen With a pressure drop of 10 psi over the screen plate, one only requires 20 psi feed pressure.

The low feed pressure can be a drawback, if the stock temperature is high due to increased risk for cavitation at higher temperatures. To eliminate this possible problem in some applications for the barrier former the described embodiments of barrier former type B and C show a pressurized housing which will allow the feed pressure to be increased until the risk for cavitation and lack of energy transfer to the pulp is eliminated.

The basic goal for the barrier former is to obtain a superior formation in spite of high feed consistency, that is superior fiber distribution in the plane of the sheet. It has been shown that the concept of the sheet formation through a barrier makes it possible to achieve this goal at a high consistency.

Figure 4:
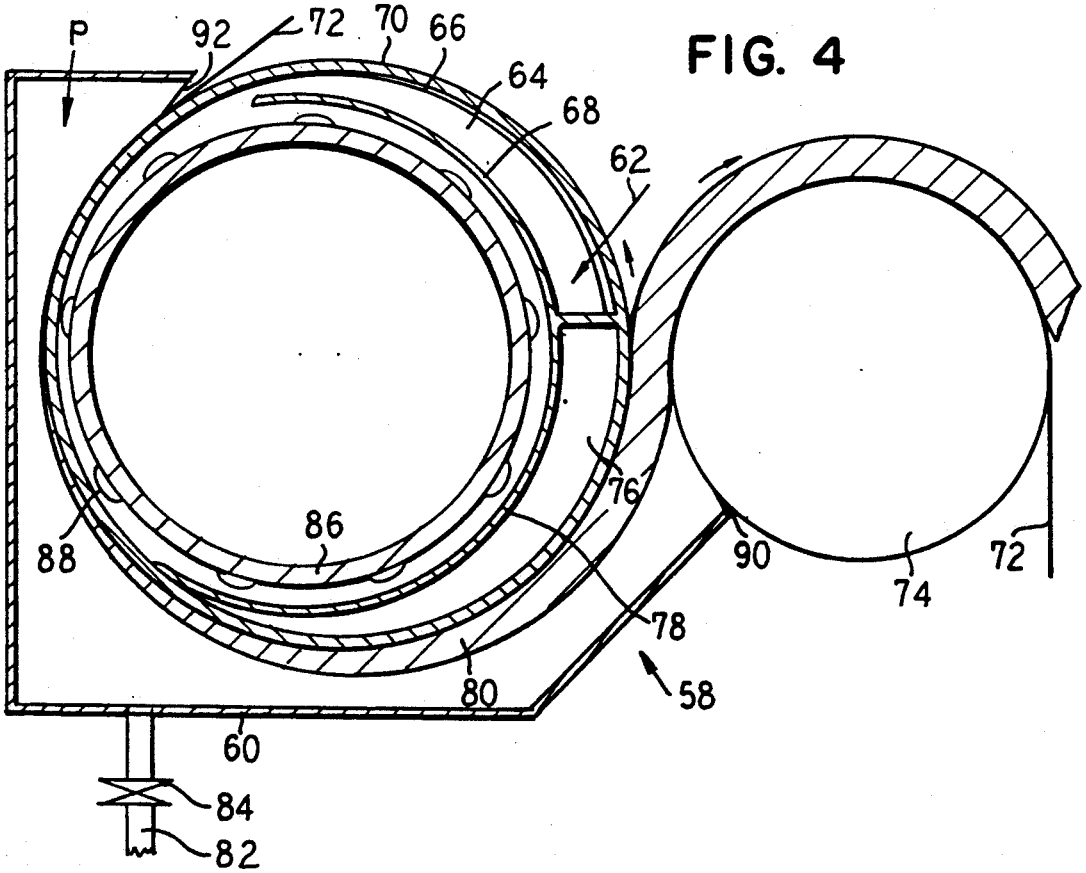
FIG. 4 is a sectional view of a high consistency sheet former employing a rotatable screen barrier.
Figure 5:
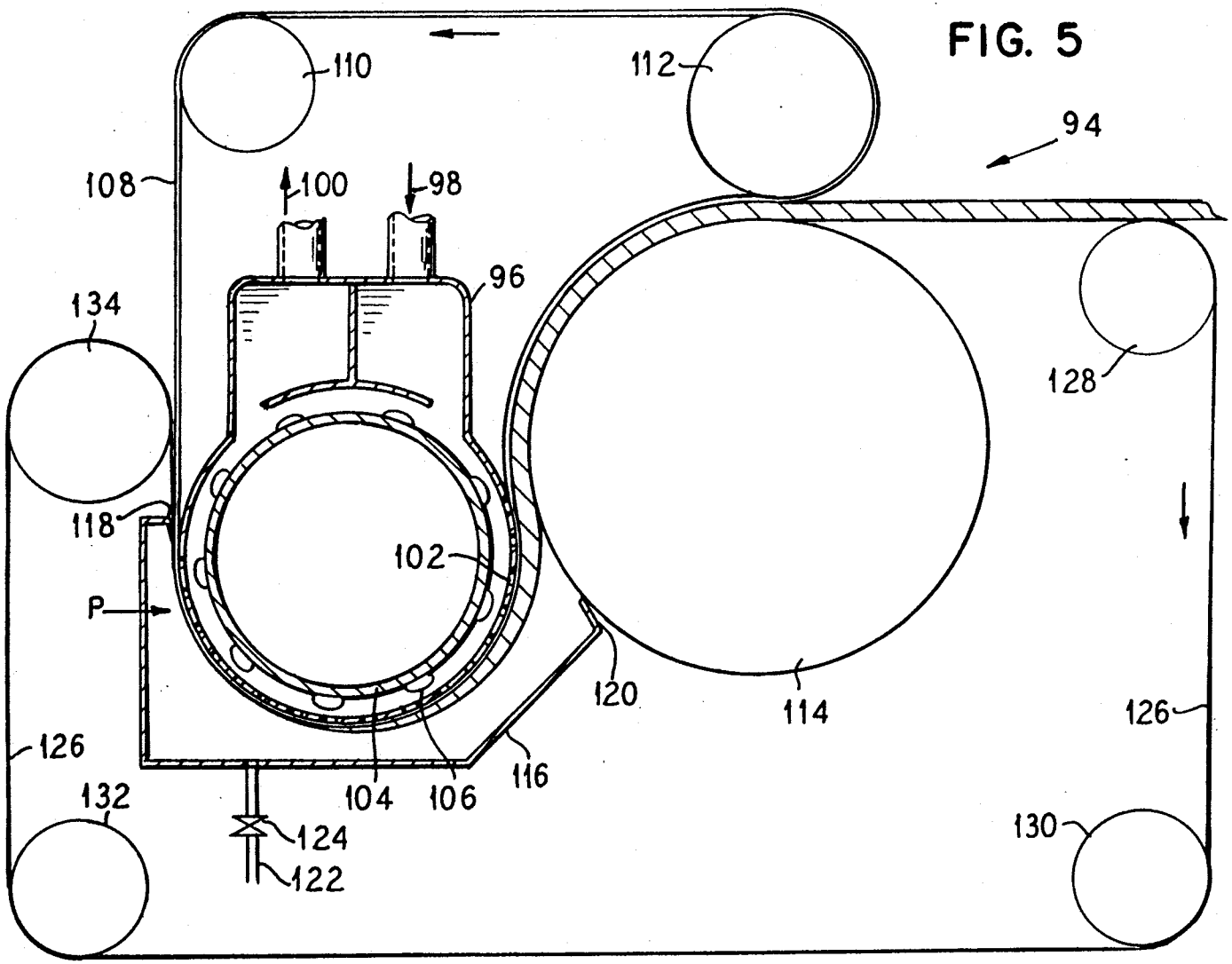
FIG. 5 is a sectional view of a high consistency sheet former employing an endless barrier band.

In the embodiments shown in FIGS. 4 and 5 it is possible to control the fiber orientation by controlling the relative velocities of the rotating screen or the moving perforate band with respect to the collecting wire. An increase in relative velocity is believed to increase fiber orientation in the machine direction.

FIG. 4 illustrates, in a sectional view, a sheet-former which employs a rotatable screen barrier. The former is generally illustrated at 58 as comprising a housing 60, in particular a pressurized housing as schematically indicated by the reference P. The former receives the pulp as pneumatically indicated at 62 into a tapering chamber 64 defined by a pair of walls 66,68. The wall 66 supports a rotating screen barrier 70 which is driven with a collecting wire 72, the wire 72 being continuous and taken from the former about a roll 74.

The stock is collected on the wire 72, as with the embodiment of FIG. 1, and forms a mat 78,dewatering occurring as set forth above. An internal draining zone 76 is provided as defined by the rotating barrier 70 and a member 78. The pressurized housing 60 is sealed at 90, 92 and is provided with a drain pipe 82 and a valve 84 for controlled water discharge.

As with the embodiment of FIG. 1, a rotor 86 is provided and carries a plurality of pulse generators 88 for creating turbulence in the gap between the rotor and the rotating screen barrier 70.

Turning to FIG. 5, a sheetformer is generally illustrated at 94 as comprising a housing 96 which receives pulp at an inlet 98 and has a discharge overflow 100. The pulp flows between a stationary barrier band support 102 and a rotor 104 having a plurality of pulse generators 106 thereon. A perforate barrier band 108 is entrained about the stationary barrier band support 102 and a plurality of rolls 110, 112, 114.

The perforate portion of the stationary barrier is housed in a pressurized housing 116 which is sealed at 118, 120 and which is provided with a drain pipe 122 with a valve 124 for controlled water discharge.

A collecting wire 126 is entrained about the perforate barrier band 108 and about a plurality of rolls 128, 130, 132 and 134.

The basic concept of the barrier former, with a stationary screen barrier as shown in FIG. 1, makes it possible to control the fiber orientation and sheet structure by adjusting the ratio between the stock pressure, after the barrier, to the tension of the wire. With increased wire tension, it is believed that it is possible to push and continuously deform the fluid wedge between the barrier screen and the wire in the machine direction of the former. Another possibility is to orient some of the fibers in the center of the sheet in the Z-direction, that is perpendicular to the sheet, which would be particularly advantageous with respect to paperboard qualities.

In summary, the basic principle of the barrier sheet former of the present invention is that a high consistency pulp can be fluidized within a screen barrier (stationary or moving) which has openings, holes or slots, and which has a moving wire wrapped therearound on its outer surface. The moving collecting wire will collect the dispersed fibers at a high consistency and dewatering will start immediately due to the tension of the wire. When a screen plate is used, it is preferably polished and the rotor is designed for a high frequency, high energy transfer to a relatively small gap between the rotor and the screen in order to fluidize the incoming stock at the highest possible consistency. The defloculated stock loses most of its energy when it passes through the screen plate and is collected on the wire. When the pulp is distributed on the wire the consistency is sufficiently high to prevent refloculation during the very short dewatering phase.

Although I have described my invention by reference to a particular illustrative embodiment thereof, many changes and modifications of the invention may become apparent to those skilled in the art without departing from the spirit and scope of the invention. I therefore intend to include within the patent warranted hereon all such changes and modifications as may reasonably and properly be included within the scope of my contribution to the art.

I claim:

1. A barrier former comprising:

chamber means defining a chamber and including a slurry inlet for receiving a flow of fiber slurry under pressure and a perforate arcuate barrier wall including a plurality of discrete screen-like openings for distributing the fiber slurry therethrough;

rotor means including a rotor mounted for rotation adjacent and closely spaced from said arcuate barrier wall and forming a gap therebetween for receiving the slurry, said rotor creating turbulence in the slurry adjacent the barrier wall to provide defloculation at high consistency;

a plurality of spaced rolls and drive means for driving at least one of said rolls;

a collecting wire entrained about said plurality of rolls and at least partially about said perforate arcuate barrier wall for receiving the distributed fiber slurry to form a web, and a forming zone defined by an area of said perforate arcuate barrier and said collecting wire entrained there about;

an initial dewatering means associated with said forming zone including a pressure fed area of said forming zone and tensioning means for said collecting wire counteracting slurry pressure in said pressure fed area to begin immediate dewatering by controlling drainage from said web within said forming zone.

2. The barrier former of claim 1, wherein said chamber means further includes:

an arcuate wall spaced from said rotor on the side of said rotor opposite said perforate arcuate barrier wall of said chamber means.

3. The barrier former of claim 1, wherein said chamber means further includes:

a deflector mounted adjacent said inlet to provide a tortuous path between said inlet and the gap between said rotor and said perforate arcuate wall.

4. The barrier former of claim 1, wherein said rotor means further includes:

projections extending from said rotor in the gap between said rotor and said perforate arcuate wall.

5. The barrier former of claim 1, wherein said chamber means further includes:

an overflow outlet.

6. The barrier former of claim 1, wherein said collecting wire tensioning means comprises:

means pivotally mounting at least one of said rolls.

7. A sheet former comprising:

a stationary, curved, perforate, arcuate plate including first and second sides for distributing a fiber slurry therethrough, said plate including a plurality of discrete screen-like openings extending therethrough;

turbulence means comprising a rotor conforming, immediately adjacent and in close proximity to said arcuate plate for receiving and fluidizing the fiber slurry on said first side of said arcuate plate;

collecting means on said second side of said arcuate plate immediately adjacent to and disposed at least partially about said arcuate plate, said collecting means being operable to continuously collect the distributed fibers as a moving web as fibers pass through said openings;

dewatering means operable to increase the consistency of the web and minimize refloculation of fibers within the area of said collecting means disposed about said arcuate plate;

said perforate arcuate plate comprising an outer polished surface; and said collecting means comprising a dewatering wire for engagement with said polished surface.

* * * * *